US006303269B1

(12) United States Patent
Morita et al.

(10) Patent No.: US 6,303,269 B1
(45) Date of Patent: Oct. 16, 2001

(54) DYE PRECURSOR, PHOTOSENSITIVE MATERIAL CONTAINING DYE PRECURSOR AND METHOD FOR FORMING COLOR IMAGE

(75) Inventors: Kensuke Morita; Koki Nakamura; Shun-ichi Ishikawa, all of Minami Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/539,787

(22) Filed: Mar. 31, 2000

(30) Foreign Application Priority Data

Mar. 31, 1999 (JP) ..... 11-093431
Mar. 31, 1999 (JP) ..... 11-093432
Mar. 31, 1999 (JP) ..... 11-093433

(51) Int. Cl.[7] ..... G03C 1/00

(52) U.S. Cl. ..... 430/270.1; 430/270.15; 430/170; 430/955; 564/47

(58) Field of Search ..... 430/270.1, 543, 430/558, 955, 270.15, 170; 564/47

(56) References Cited

U.S. PATENT DOCUMENTS 3,949,143 * 4/1976 Schlesinger ..... 428/413
4,340,662 * 7/1982 Ovshinsky et al. ..... 430/270
4,859,568 * 8/1989 Takeda et al. ..... 430/269
5,230,981 * 7/1993 Saito et al. ..... 430/138
5,585,217 * 12/1996 Oba ..... 430/191

FOREIGN PATENT DOCUMENTS

WO9000978 2/1990 (WO) .
WO9422052 9/1994 (WO) .

* cited by examiner

*Primary Examiner*—Janet Baxter
*Assistant Examiner*—Amanda C. Walke
(74) *Attorney, Agent, or Firm*—Birch, Stewart, Kolasch & Birch, LLP

(57) ABSTRACT

A dye precursor represented by the following formula (I):

(I)

wherein $A^1$ and $A^2$ each represents an atomic group to form a coupler residue together with $—N(R^5)R^6$ and the carbon atom to which $A^1$ and $A^2$ are bonded; $R^1$ represents a substituent; n represents an integer of from 0 to 4; $R^2$ represents a hydroxyl group or a group represented by $—N(R^7)R^8$; $R^7$ and $R^8$ each independently represents a hydrogen atom or a substituent; $R^3$ and $R^4$ each independently represents a hydrogen atom or an alkyl group; and $R^5$ and $R^6$ each independently represents a substituent.

6 Claims, No Drawings

DYE PRECURSOR, PHOTOSENSITIVE MATERIAL CONTAINING DYE PRECURSOR AND METHOD FOR FORMING COLOR IMAGE

FIELD OF THE INVENTION

The present invention relates to a dye precursor and a photosensitive material useful for a printing material for digital image information output and the like, and a method for forming a color image using the dye precursor.

BACKGROUND OF THE INVENTION

A dye precursor which forms a dye by heating is disclosed in WO 90/00978, and a dye precursor represented by the following formula is disclosed as one example:

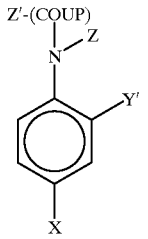

wherein X represents —NR'R" (wherein R' and R" each is selected from a hydrogen atom and an alkyl group having from 1 to 6 carbon atoms); Y' represents a hydrogen atom, an alkyl group or a substituted alkyl group; and Z and Z' each represents a protective group capable of being removed by heating or a dissociative group.

As examples of a dissociative group on a nitrogen atom or a protective group capable of being removed by heating on a nitrogen atom, an alkylsulfonyl group, an arylsulfonyl group and the groups represented by the following formulae (a) and (b):

(a)

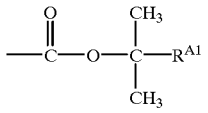

wherein $R^{A1}$ represents an alkyl group generally having from 1 to 6 carbon atoms, a halomethyl group such as a methyl group substituted with 1, 2 or 3 halo groups (e.g., chloro or bromo), or a substituted or unsubstituted aryl group (generally a phenyl group);

(b)

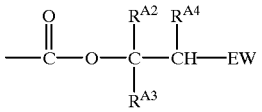

wherein $R^{A2}$ and $R^{A3}$ each represents a hydrogen atom, an alkyl group or an aryl group (generally a phenyl group); $R^{A4}$ represents a hydrogen atom, an alkyl group, an aryl group (generally a phenyl group), or EW; and EW represents an electron attractive group.

However, the dye precursor represented by the above formula having a dissociative group or a protective group represented by Z cannot satisfy the conditions that the heat stability of the dye precursor under a neutral or basic condition should be sufficiently high and the color-forming capability under an acidic condition should be sufficiently high.

Dye precursors which form dyes by oxidizing agents such as silver salts are known and disclosed in WO 94/22052. As these dye precursors form dyes by an oxidation reaction, coupler components other than 4-equivalent couplers cannot be used. Further, these dye precursors did not substantially form dyes by the action of an acid.

That is, dye precursors which substantially do not form a dye by heating the dye precursor alone or by an oxidation reaction but rapidly form a dye by the action of an acid have not been known yet.

However, a photosensitive material containing a dye precursor represented by the above-described formula is not known.

Photosensitive materials containing dye precursors are disclosed in WO 94/22052. As these dye precursors form dyes by an oxidation reaction, coupler components other than 4-equivalent couplers cannot be used. Further, these techniques require to use an oxidizing agent such as a silver salt which is not desirable for a printing material for digital image information output.

That is, photosensitive materials containing dye precursors which do not necessitate oxidizing agents such as silver salts for color-forming have not been known yet.

Dye precursors which form azomethine dyes are disclosed in WO 90/00978 and WO 94/22052. Specific examples of coupler residues for use in the dye precursors disclosed in these publications are a pyrazolone type coupler, a phenol type coupler and a naphthol type coupler. However, magenta and cyan dyes formed from the dye precursors containing these coupler residues were inferior in absorption coefficient and absorption wavelength.

SUMMARY OF THE INVENTION

An object of the present invention is to provide a dye precursor useful for a printing material for digital image information output which substantially does not form a dye by heating the dye precursor alone or by the action of an oxidizing agent but rapidly forms a dye by the action of an acid.

Another object of the present invention is to provide a photosensitive material containing a dye precursor useful for a printing material for digital image information output which does not necessitate an oxidizing agent such as a silver salt in color-forming.

A further object of the present invention is to provide a method for forming a color image using a dye precursor useful for a printing material for digital image information output, which shows high color density and forms a color having excellent absorption wavelength.

The above-described objects of the present invention have been attained by the following means:

(1) A dye precursor represented by the following formula (I):

(I)

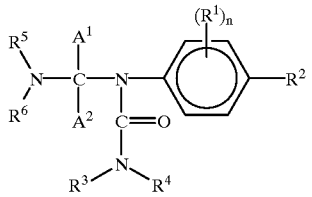

wherein $A^1$ and $A^2$ each represent an atomic group to form a coupler residue together with —$N(R^5)(R^6)$ and the carbon atom to which $A^1$ and $A^2$ are bonded; $R^1$ represents a substituent; n represents an integer of from 0 to 4; $R^2$ represents a hydroxyl group or a group represented by —$N(R^7l)R^8$; $R^7$ and $R^8$ each independently represents a hydrogen atom or a substituent; $R^3$ and $R^4$ each independently represents a hydrogen atom or an alkyl group; and $R^5$ and $R^6$ each independently represents a substituent.

(2) The dye precursor as described in the above item (1), which substantially does not form a dye by heating the dye precursor alone or by an oxidation reaction but forms a dye by the action of an acid.

(3) A photosensitive material which contains a dye precursor represented by formula (I).

(4) A photosensitive material which contains a dye precursor represented by formula (I) and a polymerizable electrophilic agent.

(5) A method for forming a color image which comprises using a dye precursor represented by the following formula (Ia), along with an oxidizing agent, an acid or a combination thereof, and effecting heat treatment:

(Ia)

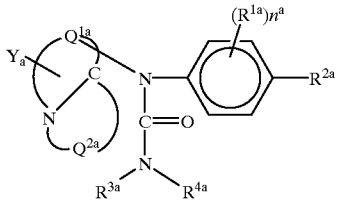

wherein $R^{1a}$ represents a substituent; $n^a$ represents an integer of from 0 to 4; $R^{2a}$ represents a hydroxyl group or a group represented by —$N(R^{5a})R^{6a}$; $R^{5a}$ and $R^{6a}$ each independently represents a hydrogen atom or a substituent; $Q^{1a}$ and $Q^{2a}$ each represents a nonmetallic atomic group necessary to form a nitrogen-containing heterocyclic condensed type coupler residue together with the nitrogen atom, the carbon atom, and $Y_a$; $R^{3a}$ and $R^{4a}$ each independently represents a hydrogen atom or an alkyl group; $Y^a$ represents a hydrogen atom or a group represented by —$N(R^{7a})R^{8a}$ bonded to the coupling position of the coupler mother nucleus; and $R^{7a}$ and $R^{8a}$ each independently represents a substituent.

DETAILED DESCRIPTION OF THE INVENTION

The dye precursors for use in the present invention will be described in detail below.

In the first place, examples of the coupler residues represented by $(R^5)(R^6)N—C(A^1)(A^2)$— in the dye precursor represented by formula (I) will be explained below.

The coupler residues preferably used in the present invention have the structures represented by the following formulae (1) to (12). These are the residues of the compounds generally called active methylene, pyrazolone, pyrazoloazole, phenol, naphthol, and pyrrolotriazole.

(1)

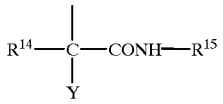

(2)

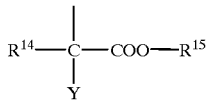

(3)

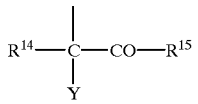

(4)

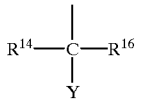

(5)

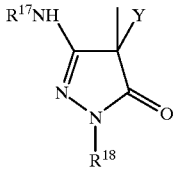

(6)

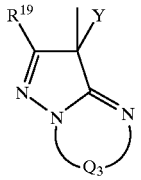

(7)

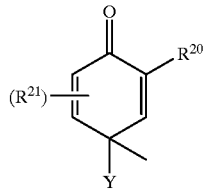

(8)

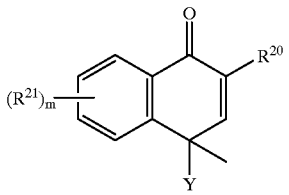

-continued (9)

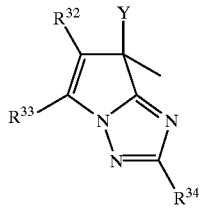

(10)

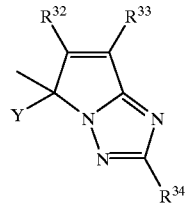

(11)

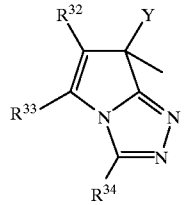

(12)

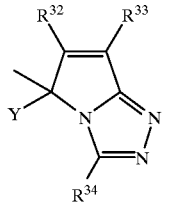

Formulae (1) to (4) represent the residues of couplers called active methylene couplers, wherein $R^{14}$ represents an acyl group, a cyano group, a nitro group, an aryl group, a heterocyclic residue, an alkoxycarbonyl group, an aryloxycarbonyl group, a carbamoyl group, a sulfamoyl group, an alkylsulfonyl group, or an arylsulfonyl group, each of which may have a substituent.

In formulae (1) to (3), $R^{15}$ represents an alkyl group, an aryl group, or a heterocyclic residue, each of which may have a substituent. In formula (4), $R^{16}$ represents an aryl group or a heterocyclic residue, each of which may have a substituent. As the substituents which $R^{14}$, $R^{15}$ and $R^{16}$ may have, examples of $R^1$ described later can be exemplified.

In formulae (1) to (4), Y represents a group represented by $—N(R^5)(R^6)$ in formula (I).

In formulae (1) to (4), $R^{14}$ and $R^{15}$, and $R^{14}$ and $R^{16}$ may be bonded to each other to form a ring.

Formula (5) represents the residue of a coupler called a 5-pyrazolone coupler, wherein $R^{17}$ represents an alkyl group, an aryl group, an acyl group or a carbamoyl group; $R^{18}$ represents a phenyl group or a phenyl group substituted with at least one atom or group selected from the group consisting of a halogen atom, an alkyl group, a cyano group, an alkoxyl group, an alkoxycarbonyl group and an acylamino group.

Of the 5-pyrazolone coupler residues represented by formula (5), those in which $R^{17}$ represents an aryl group or an acyl group and $R^{18}$ represents a phenyl group substituted with one or more halogen atoms are preferred.

These preferred groups are described in detail below. $R^{17}$ represents an aryl group such as a phenyl group, a 2-chlorophenyl group, a 2-methoxyphenyl group, a 2-chloro-5-tetradecanamidophenyl group, a 2-chloro-5-(3-octadecenyl-1-succinimido)phenyl group, a 2-chloro-5-octadecylsulfonamido-phenyl group, or a 2-chloro-5-[2-(4-hydroxy-3-t-butyl-phenoxy)tetradecanamido]phenyl group, or an acyl group such as an acetyl group, a 2-(2,4-di-t-pentylphenoxy)butanoyl group, a benzoyl group, or a 3-(2,4-di-t-amylphenoxyacetamido)benzoyl group, and these groups may further have a substituent such as a halogen atom or an organic substituent substituted via a carbon atom, an oxygen atom, a nitrogen atom or a sulfur atom. Y has the same meaning as described above.

$R^{18}$ preferably represents a substituted phenyl group such as a 2,4,6-trichlorophenyl group, a 2,5-dichlorophenyl group or a 2-chlorophenyl group.

Formula (6) represents the residue of a coupler called a pyrazoloazole coupler, wherein $R^{19}$ represents a hydrogen atom or a substituent; $Q^3$ represents a nonmetallic atomic group necessary to form a 5-membered ring containing from 2 to 4 nitrogen atoms such as an azole ring, and the ring may have a substituent (including a condensed ring).

Of the pyrazoloazole coupler residues represented by formula (6), imidazo[1,2-b]pyrazoles disclosed in U.S. Pat. No. 4,500,630, pyrazolo[1,5-b]-1,2,4-triazoles disclosed in U.S. Pat. No. 4,500,654, and pyrazolo[5,1-c]-1,2,4-triazoles disclosed in U.S. Pat. No. 3,725,067 are preferred in view of spectral absorption characteristics of the dye formed. Examples of the substituent represented by $R^{19}$ include those represented by $R^{a1}$, namely $R^1$ in formula (I).

Details of the substituents represented by $R^{19}$ and the substituents of the azole ring represented by $Q^3$ are disclosed, e.g., in U.S. Pat. No. 4,540,654, from column 2, line 41 to column 8, line 27. Preferred examples thereof include pyrazoloazole couplers in which a branched alkyl group is directly bonded to the 2, 3 or 6-position of a pyrazolotriazole group as disclosed in JP-A-61-65245 (the term "JP-A" as used herein means an "unexamined published Japanese patent application"), pyrazoloazole couplers having a sulfonamido group in the molecule as disclosed in JP-A-61-65245, pyrazoloazole couplers having an alkoxyphenylsulfonamido ballast group as disclosed in JP-A-61-147254, pyrazolotriazole couplers having an alkoxyl group or an aryloxy group at the 6-position as disclosed in JP-A-62-209457 and JP-A-63-307453, and pyrazolotriazole coupler residues having a carbonamido group in the molecule as disclosed in Japanese Patent Application No. 1-22279. Y has the same meaning as described above.

Formulae (7) and (8) represent the residues of couplers called a phenol coupler and a naphthol coupler, respectively, wherein $R^{20}$ represents a hydrogen atom, or a group selected from the group consisting of $—CONR^{22}R^{23}$, $—SO_2NR^{22}R^{23}$, $—NHCOR^{22}$, $—NHCONR^{22}R^{23}$, and $—NHSO_2NR^{22}R^{23}$; and $R^{22}$ and $R^{23}$ each independently represents a hydrogen atom or a substituent.

In formulae (7) and (8), $R^{21}$ represents a substituent, 1 represents an integer of from 0 to 2, and m represents an integer of from 0 to 4. When 1 and m each represents 2 or higher, $R^{21}$'s may be different from each other. As the substituents represented by $R^{21}$, $R^{22}$ and $R^{23}$, examples of $R^1$ described later can be exemplified. Y has the same meaning as described above.

Preferred examples of the phenol coupler residues represented by formula (8) include 2-acylamino-5-alkylphenol coupler residues disclosed in U.S. Pat. Nos. 2,369,929, 2,801,171, 2,772,162, 2,895,826 and 3,772,002, 2,5-diacylaminophenol coupler residues disclosed in U.S. Pat. Nos. 2,772,162, 3,758,308, 4,126,396, 4,334,011, 4,327,173, West German Patent (OLS) 3,329,729, and JP-A-59-166956, and 2-phenylureido-5-acylaminophenol coupler residues disclosed in U.S. Pat. Nos. 3,446,622, 4,333,999, 4,451,559 and 4,427,767. Y has the same meaning as described above.

Preferred examples of the naphthol coupler residues represented by formula (7) include 2-carbamoyl-1-naphthol coupler residues disclosed in U.S. Pat. Nos. 2,474,293, 4,052,212, 4,146,396, 4,282,233 and 4,296,200, and 2-carbamoyl-5-amido-1-naphthol coupler residues disclosed in U.S. Pat. No. 4,690,889.

Formulae (9) to (12) represent the residues of couplers called pyrrolotriazole couplers, wherein $R^{32}$, $R^{33}$ and $R^{34}$ each independently represents a hydrogen atom or a substituent. Y has the same meaning as described above. As the substituents represented by $R^{32}$, $R^{33}$ and $R^{34}$, examples of $R^1$ described later can be exemplified. Preferred examples of the pyrrolotriazole coupler residues represented by formulae (9) to (12) include coupler residues in which at least either of $R^{32}$ or $R^{33}$ represents an electron attractive group disclosed in EP-A-488248, EP-A-491197 and EP 545300. Y has the same meaning as described above.

In addition to the above-described coupler residues, coupler residues having the structure such as condensed phenol, imidazole, pyrrole, 3-hydroxypyridine, active methylene, active methine, 5,5-condensed heterocyclic ring, and 5,6-condensed heterocyclic ring can be used in the present invention.

As condensed phenol coupler residues, coupler mother nuclei disclosed in U.S. Pat. Nos. 4,327,173, 4,564,586, and 4,904,575 can be used.

As imidazole coupler residues, coupler mother nuclei disclosed in U.S. Pat. Nos. 4,818,672 and 5,051,347 can be used.

As 3-hydroxypyridine coupler residues, coupler mother nuclei disclosed in JP-A-1-315736 can be used.

As active methylene and active methine coupler residues, coupler mother nuclei disclosed in U.S. Pat. Nos. 5,104,783 and 5,162,196 can be used.

As 5,5-condensed heterocyclic ring coupler residues, pyrrolopyrazole coupler mother nuclei disclosed in U.S. Pat. No. 5,164,289, and pyrroloimidazole coupler mother nuclei disclosed in JP-A-4-174429 can be used.

As 5,6-condensed heterocyclic ring coupler residues, pyrazolopyrimidine coupler mother nuclei disclosed in U.S. Pat. No. 4,950,585, pyrrolotriazine coupler mother nuclei disclosed in JP-A-4-204730, and coupler mother nuclei disclosed in EP 556700 can be used.

Besides the above coupler residues, coupler mother nuclei disclosed in West German Patents 3,819,051A, 3,823,049, U.S. Pat. Nos. 4,840,883, 5,024,930, 5,051,347, 4,481,268, EP-A-304856, EP 329036, EP-A-354549, EP-A-374781, EP-A-379110, EP-A-386930, JP-A-63-141055, JP-A-64-32260, JP-A-64-32261, JP-A-2-297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731, and JP-A-4-204732 can also be used in the present invention.

Examples of $R^1$ in formula (I) include a halogen atom (e.g., chlorine, bromine), an alkyl group (e.g., methyl, ethyl, isopropyl, n-butyl, t-butyl), an aryl group (e.g., phenyl, tolyl, xylyl), a carbonamido group (e.g., acetylamino, propionylamino, butyroylamino, benzoylamino), a sulfonamido group (e.g., methanesulfonylamino, ethanesulfonylamino, benzenesulfonylamino, toluenesulfonylamino), an alkoxyl group (e.g., methoxy, ethoxy), an aryloxy group (e.g., phenoxy), an alkylthio group (e.g., methylthio, ethylthio, butylthio), an arylthio group (e.g., phenylthio, tolylthio), a carbamoyl group (e.g., methylcarbamoyl, dimethylcarbamoyl, ethylcarbamoyl, diethylcarbamoyl, dibutylcarbamoyl, piperidinocarbamoyl, morpholinocarbamoyl, phenylcarbamoyl, methylphenylcarbamoyl, ethylphenylcarbamoyl, benzylphenylcarbamoyl), a sulfamoyl group (e.g., methylsulfamoyl, dimethylsulfamoyl, ethylsulfamoyl, diethylsulfamoyl, dibutylsulfamoyl, piperidinosulfamoyl, morpholinosulfamoyl, phenylsulfamoyl, methylphenylsulfamoyl, ethylphenylsulfamoyl, benzylphenylsulfamoyl), a cyano group, a sulfonyl group (e.g., methanesulfonyl, ethanesulfonyl, phenylsulfonyl, 4-chlorophenylsulfonyl, p-toluenesulfonyl), an alkoxycarbonyl group (e.g., methoxycarbonyl, ethoxycarbonyl, butoxycarbonyl), an aryloxycarbbnyl group (e-g., phenoxycarbonyl), an acyl group (e.g., acetyl, propionyl, butyroyl, benzoyl, alkylbenzoyl), a ureido group (e.g., methylaminocarbonamido, diethylaminocarbonamido), a urethane group (e.g., methoxycarbonamido, butoxycarbonamido), or an acyloxy group (e.g., acetyloxy, propionyloxy, butyroyloxy).

$R^1$ may further have a substituent and the substituent may be the same as the above-described substituents represented by $R^1$.

$R^1$ preferably represents an alkyl group or a halogen atom, particularly preferably a methyl group.

$R^1$ preferably has from 0 to 36 carbon atoms, more preferably from 0 to 18 carbon atoms, most preferably from 0 to 10 carbon atoms.

n represents an integer of from 0 to 4. When n is 2 or higher, a plurality of $R^1$ may be different from each other or may be the same. When n is 2 or higher, $R^1$'s may be linked to each other to form a ring. n is preferably 0 or 1, particularly preferably 1.

$R^2$ represents a hydroxyl group or a group represented by $—N(R^7)R^8$. When $R^2$ is a group represented by $—N(R^7)R^8$, $R^7$ and $R^8$ each independently represents a hydrogen atom or the same substituent as described above in $R^1$. $R^7$ and $R^8$each preferably represents an alkyl group. $R^1$, $R^7$ and $R^8$ may be linked to form a ring.

$R^3$ and $R^4$ each independently represents a hydrogen atom or an alkyl group. It is preferred that either of $R^3$ or $R^4$ represents a hydrogen atom and the other represents an alkyl group, and it is more preferred that the alkyl group is a t-butyl group. When $R^3$ or $R^4$ represents an alkyl group, the alkyl group may further have a substituent, and examples of the substituent include those above-exemplified as $R^1$.

Examples of the substituents represented by $R^5$ and $R^6$ include those exemplified as $R^1$. $R^5$ and $R^6$ are preferably linked to each other to form a ring. Preferred examples of the rings formed by $R^5$, $R^6$ and the nitrogen atom include a pyrazole ring, an imidazole ring, a triazole ring, a pyridine ring, and a pyrimidine ring, with a pyrazole ring and an imidazole ring being particularly preferred.

These rings may further have substituents, and the same substituents represented by $R^1$ described above can be exemplified as the substituents. Further, these rings may form condensed rings with other rings.

Specific examples of the compounds represented by formula (I) are shown below, but the present invention is not limited to these compounds.
(I-1)
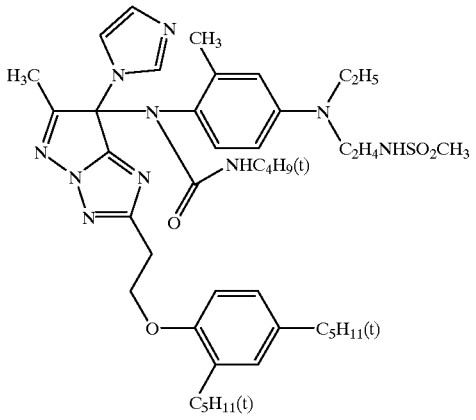
(I-2)
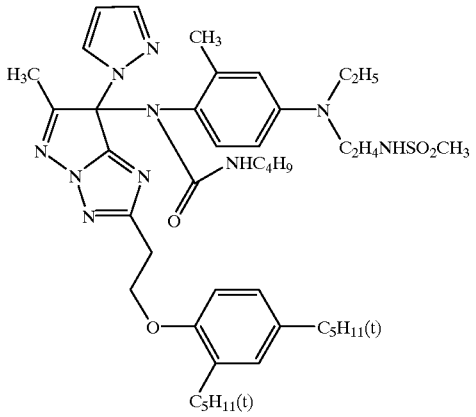
(I-3)
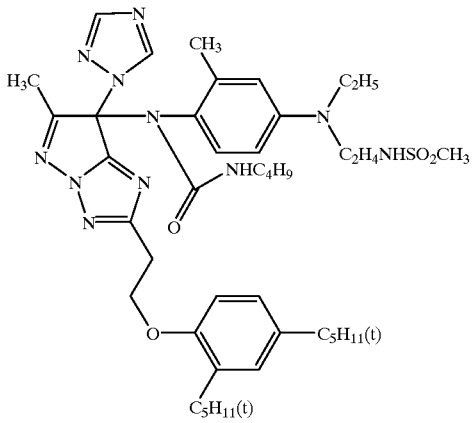

-continued
(I-4)
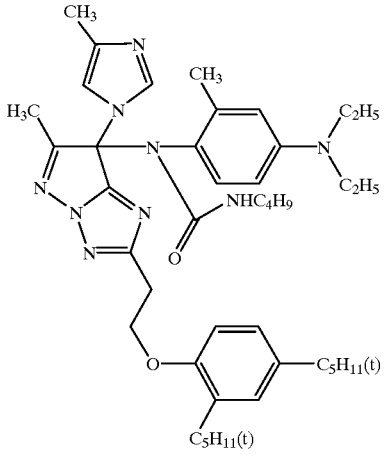
(I-5)
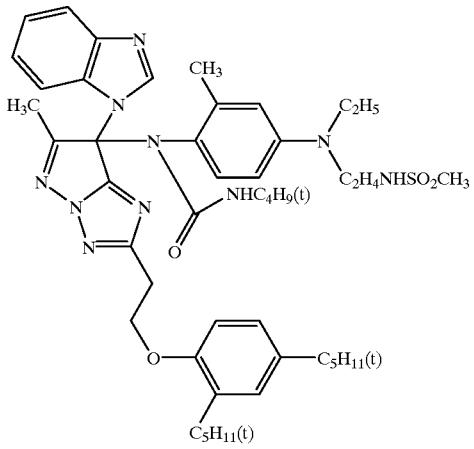
(I-6)
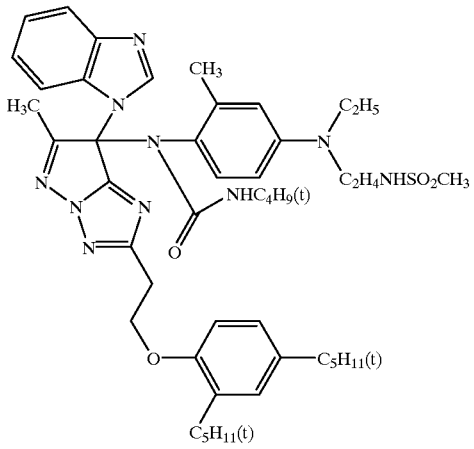

-continued
(I-7)
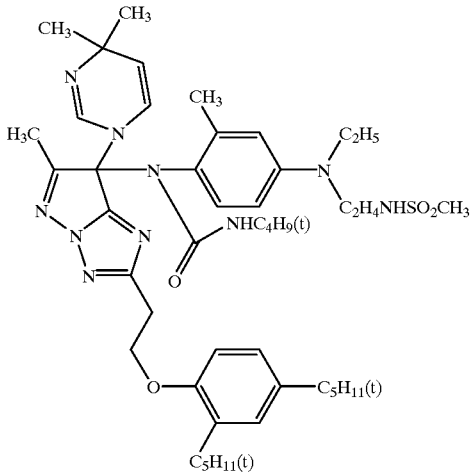
(I-8)
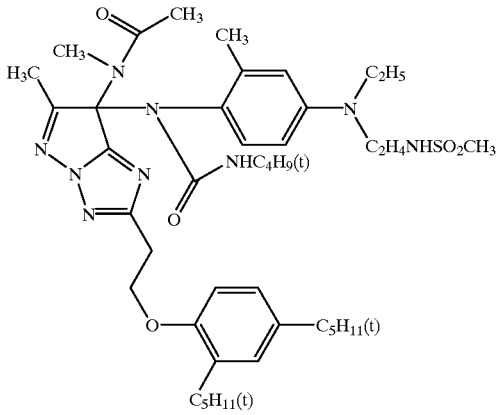
(I-9)
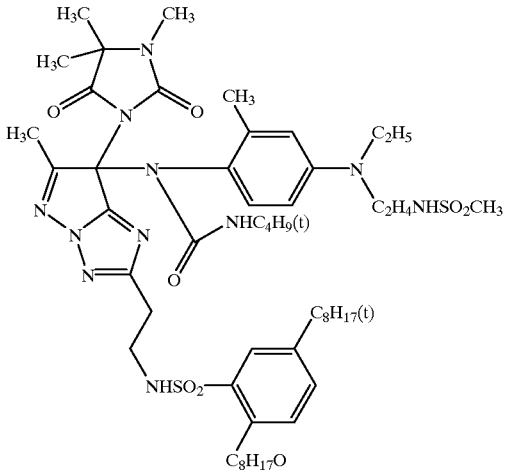

-continued
(I-10)
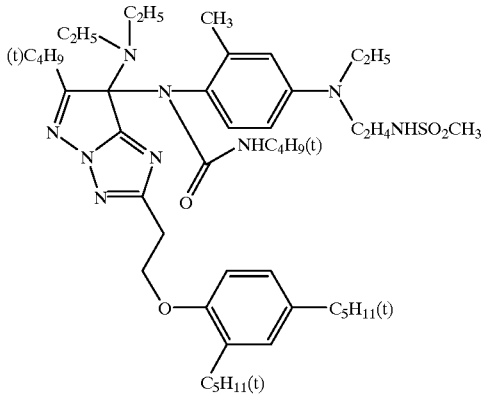
(I-11)
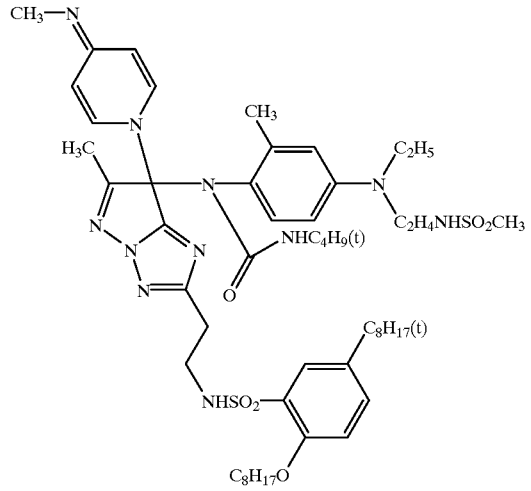
(I-12)
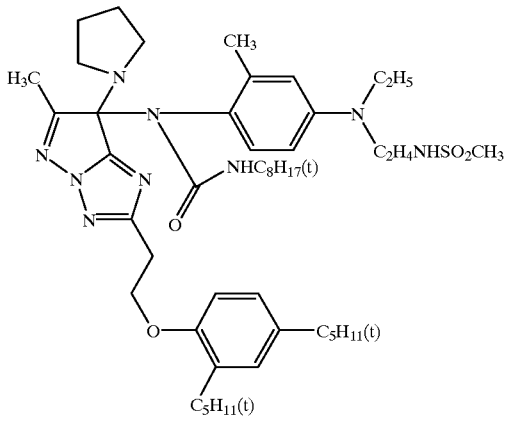

-continued
(I-13)
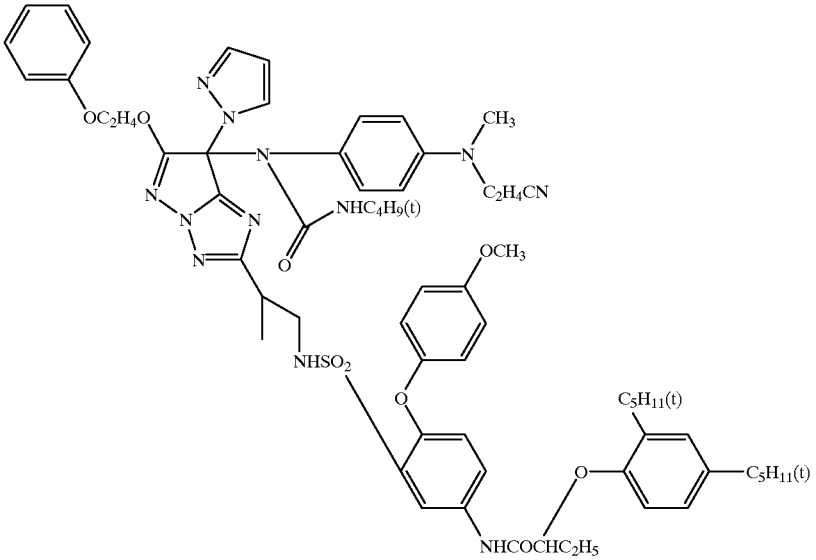
(I-14)
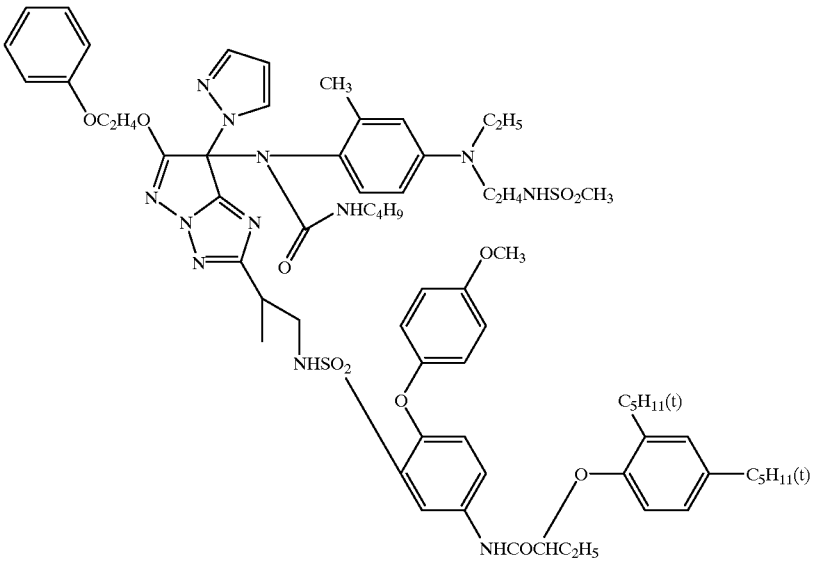

-continued
(I-15)
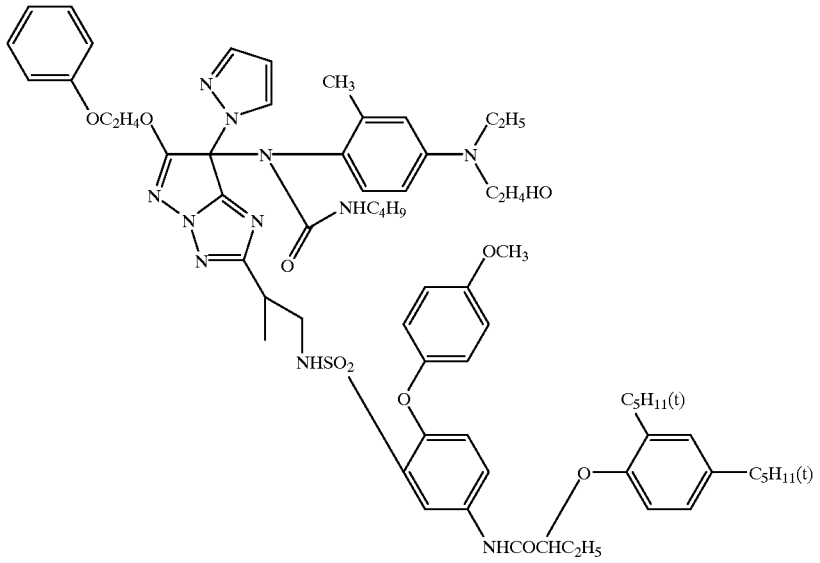
(I-16)
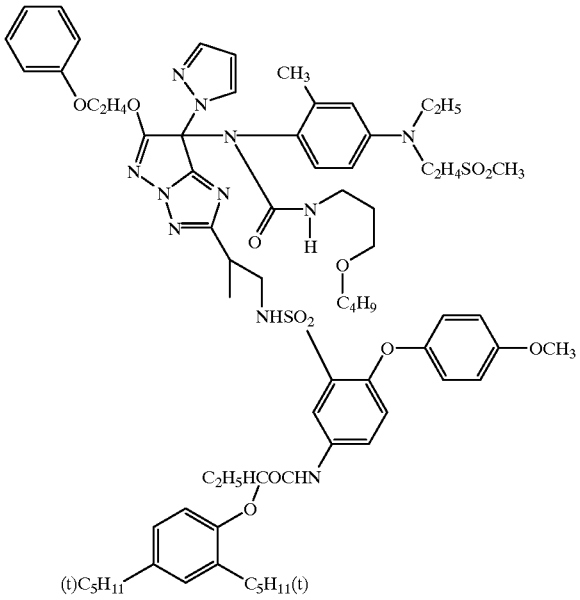

-continued
(I-17)
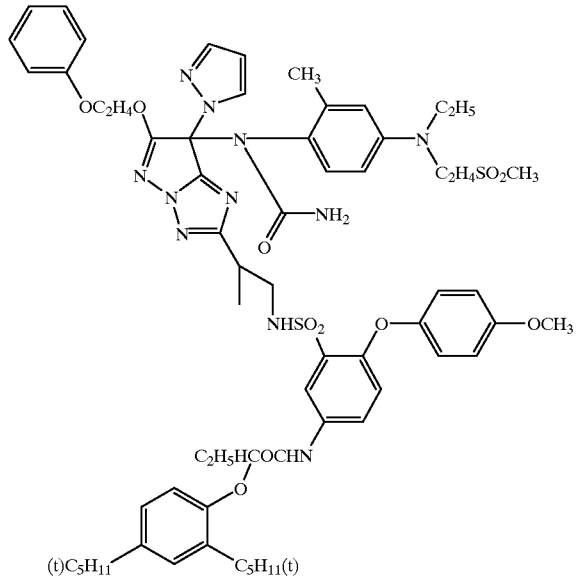
(I-18)
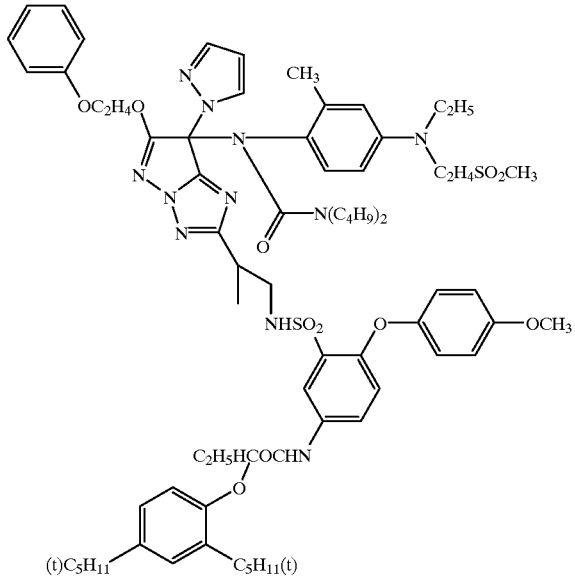
(I-19)
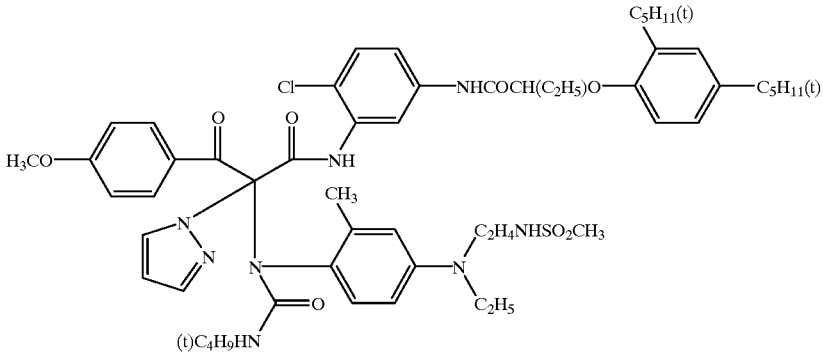

-continued
(I-20)
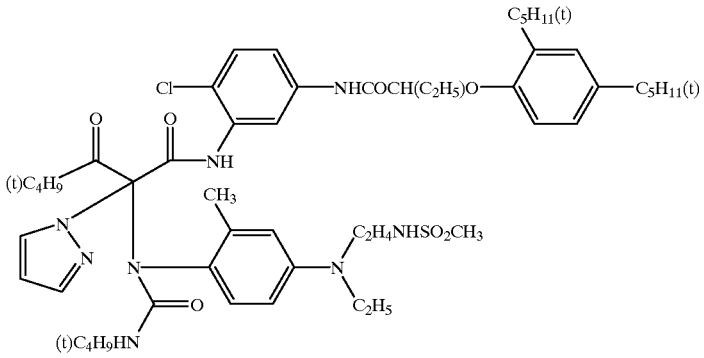
(I-21)
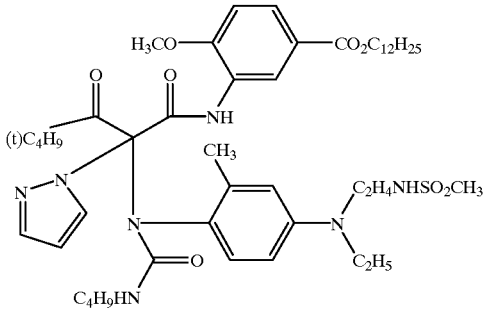
(I-22)
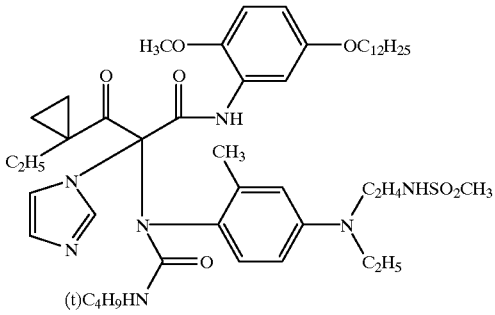
(I-23)
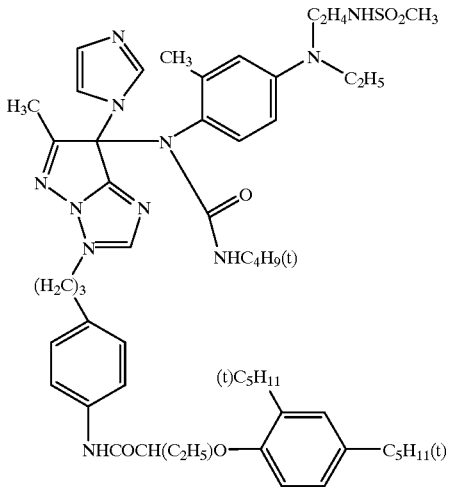

-continued
(I-24)
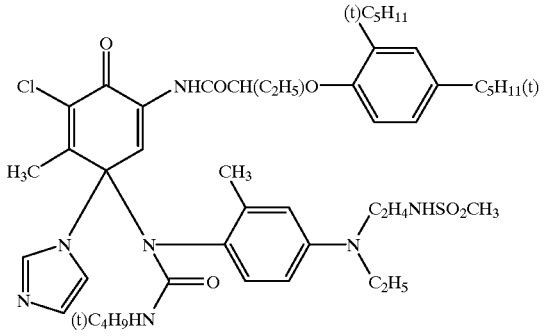
(I-25)
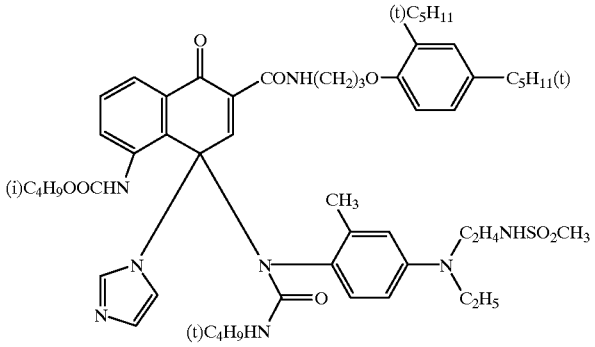
(I-26)
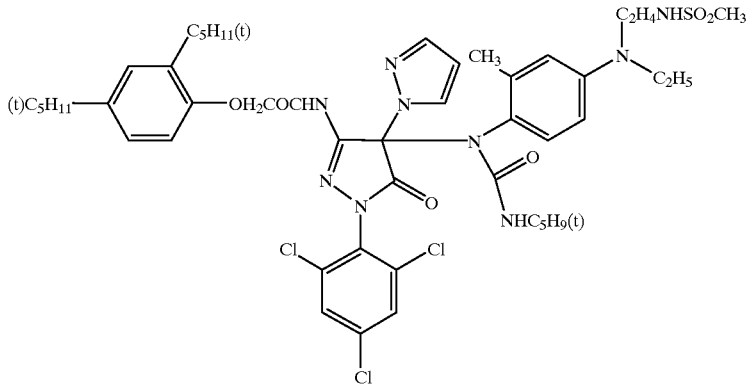
(I-27)
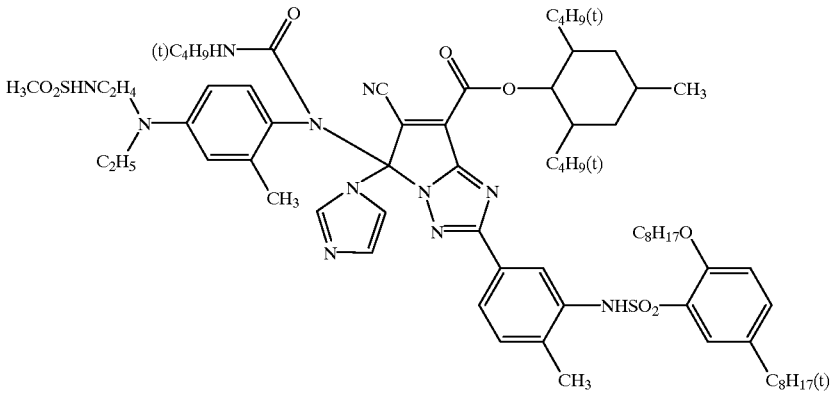

-continued (I-28)

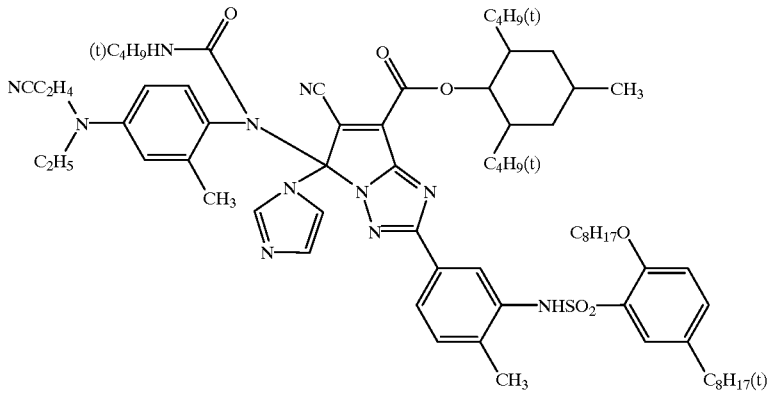

(I-29)

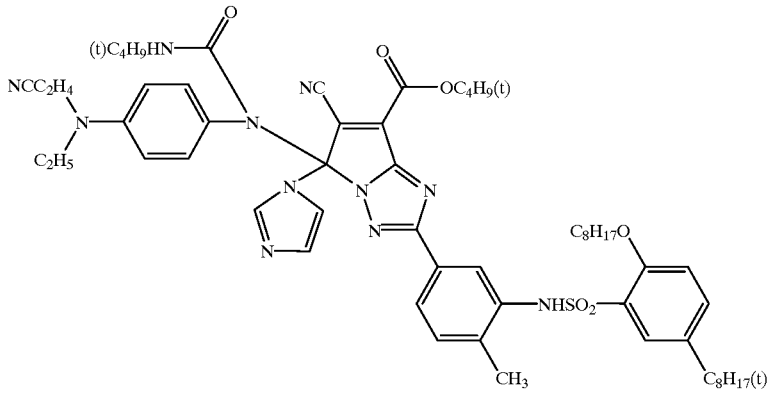

(I-30)

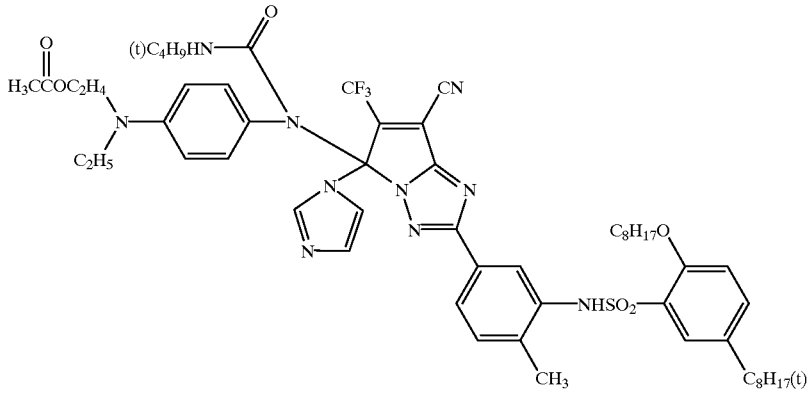

Specific examples of the producing methods of the compounds represented by formula (I) are shown below.

SYNTHESIS EXAMPLE 1

Synthesis of Compound (I-14)

Developing Agent (A-1) shown below (20 g) (54.1 mmol) was dissolved in a mixed solution of 100 ml of ethyl acetate and 200 ml of an aqueous saturated sodium hydrogencarbonate solution, and then 6.71 ml (59.5 mmol) of butyl isocyanate was added thereto followed by stirring. After one hour, the crystals precipitated were filtered out, washed with water and ethyl acetate and dried to thereby obtain 16.9 g (45.6 mmol) of Developing Agent (B-1) shown below. Developing Agent (B-1) (1.88 g) (5.07 mmol) and 4 g (4.22 mmol) of Coupler (C-1) shown below which had been synthesized by a known method were dissolved in 30 ml of dichloromethane, and 1.41 ml (10.14 mmol) of triethylamine and 10 g (115 mmol) of manganese dioxide were added thereto followed by stirring for 1 hour. After the reaction solution was filtered, the filtrate was purified by silica gel column chromatography to thereby obtain 4 g (3.04 mmol) of Compound (I-14).

Developing Agent (C-2) shown below which had been synthesized in the same manner as in Synthesis Example 1 were dissolved in 10 ml of dichloromethane, and thereto were added 0.671 ml (4.82 mmol) of triethylamine and 15 g (173 mmol) of manganese dioxide, followed by stirring for 1 hour. The reaction solution was filtered, and the filtrate was purified by silica gel column chromatography to thereby obtain 1.7 g (1.41 mmol) of Compound (I-28).

(A-1)

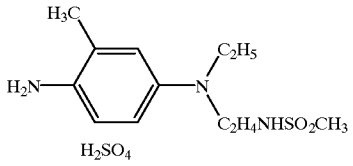

(B-1)

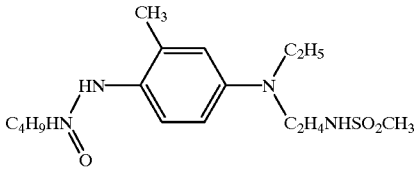

(C-1)

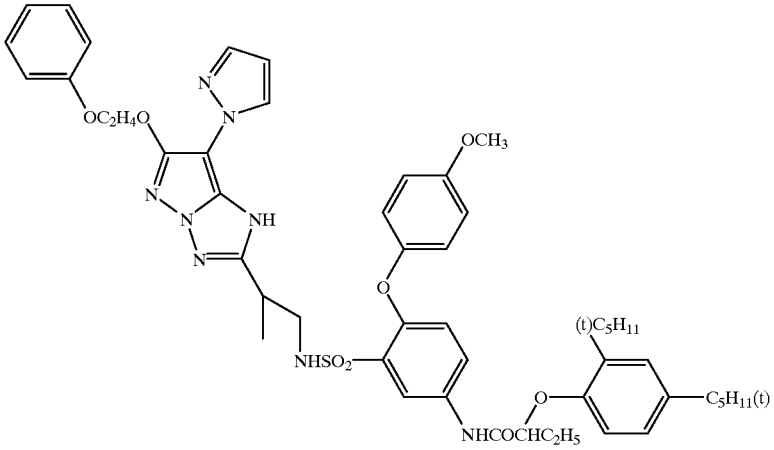

SYNTHESIS EXAMPLE 2

Synthesis of Compound (I-28)

Coupler (A-2)(6 g) (6.89 mmol) shown below which had been synthesized by a known method was dissolved in 20 ml of dichloromethane, and 1.23 g (6.89 mmol) of N-bromosuccinimide was added thereto, followed by stirring for 2 hours. The reaction solution was washed in a separating funnel, dehydrated by adding magnesium sulfate anhydride thereto, and then concentrated. The concentrate was dissolved in 20 ml of cumene, then 6 g (88.1 mmol) of imidazole was added to the solution, and the reaction solution was stirred at 130° C. for 30 minutes. The reaction solution was separated by adding water and ethyl acetate, dehydrated by adding magnesium sulfate anhydride to the organic layer, and then concentrated. The concentrate was purified by silica gel column chromatography to thereby obtain 3 g (3.20 mmol) of Coupler (B-2) shown below. The thus-obtained Coupler (B-2) and 1.06 g (3.85 mmol) of (A-2)

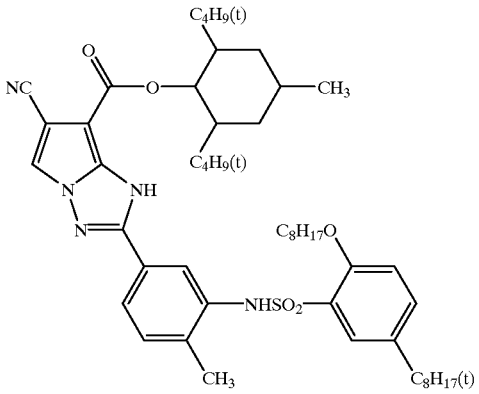

-continued (B-2)

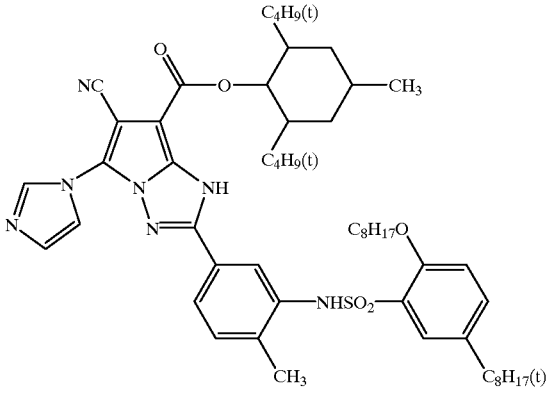

(C-2)

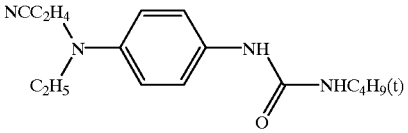

The acid compounds for use to color-develop the dye precursors according to the present invention are compounds having dissociable proton (protonic acid) and compounds known as metallic Lewis acid, and protonic acid is more preferred.

Examples of protonic acids include sulfonic acid, sulfinic acid, phosphonic acid, carboxylic acid, phenol, perchloric acid, tetrafluoroboric acid and derivatives of these compounds.

Dyes may be formed by imagewise or reverse-imagewise generating these acids on the dye precursor, or having acids separate from dye precursors and imagewise or reverse-imagewise bringing the acids into contact with dye precursors.

Specific examples of protonic acids (III-1) to (III-11) are shown below, (III-1)

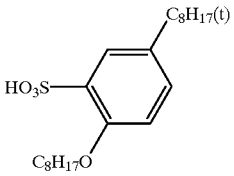

(III-2)

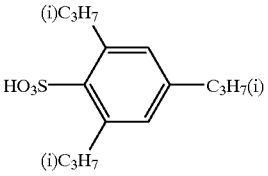

-continued (III-3)

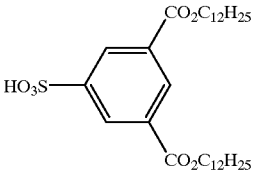

(III-4)

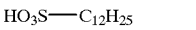

(III-5)

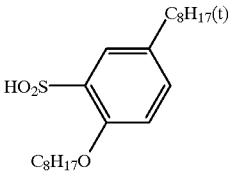

(III-6)

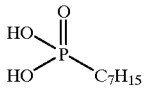

(III-7)

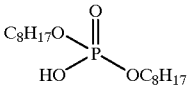

(III-8)

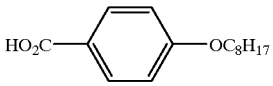

(III-9)

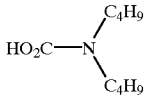

(III-10)

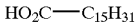

(III-11)

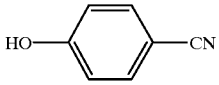

Further, for color-developing the dye precursors according to the present invention, for example, an acid generating agent which generates an acid by heat, light, or heat and light, and a polymerizable electrophilic agent can be used in the present invention.

As examples of the compounds which generate acids by exposure or exposure and heating, compounds known as photo-acid generating agents, i.e., onium salts, N-imidoyl ester, pyrogallol ester, nitrobenzyl ester, α-sulfonyloxy ketone, and tris(trichloromethyl)triazine can be exemplified. Specifically, the compounds described in S. P. Pappas, *Journal of Imaging Technology*, Vol. 11, No. 4, pp. 146 to 157 can be used. These compounds may be used in combination with sensitizing dyes.

Examples of the compound which generates an acid by heating include a compound having a protective group for blocking organic or inorganic acid, and preferred examples thereof include 3-benzenesulfonylpropionates and 4-alkoxyphenylbenzene-sulfonates.

These materials can be combined arbitrarily in the present invention. All the materials may be coated together on a support. Oil-soluble binders such as polystyrene, polyvinyl butyral, and polymethyl methacrylate may be used. Further, these materials may be used as oil droplets in a hydrophilic binder. Examples of the hydrophilic binders in this case include gelatin, polyvinyl alcohol, modified polyvinyl alcohol, cellulose derivatives, and polyacrylamide. Requisite materials may be microencapsulated.

It is possible to use a plurality of photosensitive acid generating agents having different photosensitive wavelengths and a plurality of couplers having different colors in combination to make multicolor or full color photosensitive compositions or photosensitive recording materials.

The photosensitive layer preferably has a thickness of 0.1 to 5 $\mu$m. The amount of the dye precursor is preferably from 0.01 to 100 mmol, more preferably from 0.1 to 10 mmol per 1 $m^2$ of the photosensitive material. The amount of the photosensitive acid generating agent is preferably from 0.01 to 200 times by mole, more preferably from 0.1 to 20 times by mole that of the dye precursor. The amount of the polymerizable electrophilic agent agent is preferably from 0.1 to 200 times by mole, more preferably from 0.5 to 40 times by mole that of the dye precursor.

Paper, coated paper, synthetic paper and a plastic film such as polyester are preferably used as a support in the present invention.

As an exposure light source, a mercury lamp, a xenon lamp, a halogen lamp, laser beams, an LED and a fluorescent tube can be used.

As the examples of polymerizable electrophilic agents, compounds having both a functional group which undergoes a nucleophilic substitution reaction or a nucleophilic addition reaction and a polymerizable group can be exemplified. Examples of polymerizable electrophilic agents are shown below.

(III-1)

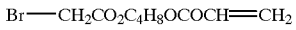

(III-2)

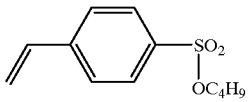

(III-3)

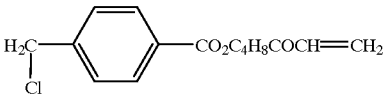

(III-4)

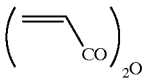

(III-5)

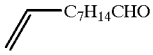

(III-6)

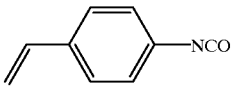

-continued (III-7)

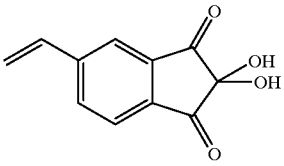

(III-8)

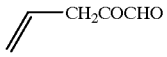

(III-9)

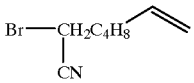

(III-10)

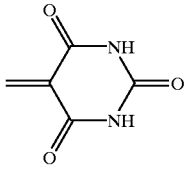

(III-11)

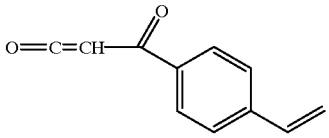

(III-12)

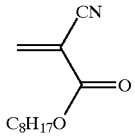

In the present invention, photopolymerization initiators can be used in combination. Many well-known compounds can be used as photopolymerization initiators. Examples of such compounds include compounds which generate radicals by Norrish I type reaction by the cleavage of the bond between a carbonyl group such as benzoinalkyl ether and the carbon atom adjacent thereto, compounds which are directly photodecomposed, such as oxime esters, peroxides, organic sulfur compounds, halides, and phosphine oxide compounds, aromatic ketones such as benzophenone, which forms ketyl radicals by a hydrogen abstraction reaction, a combination of a donor and an acceptor, such as ketone and amine, which forms exciprex and causes electron transfer and proton transfer to thereby form radicals, and photoredoxes which generate radicals such as composites of dyes and weak reducing agents. In addition, the compounds described in Monroe et al. *Chemical Review*, Vol. 93, pp. 435 to 446 (1993) can also be used.

Some of the above photopolymerization initiators have sensitivity in the visible region and they are excellent in view of capable of using a variety of visible light sources such as visible lasers, LED, and a white fluorescent lamp. As such photopolymerization initiators having sensitivity in the visible region, photopolymerization initiators comprising cationic dyes/anionic boron compound complexes are disclosed in Japanese Patent No. 2726258 and these compounds are particularly preferably used in the present invention.

In the present invention, dye-forming rate can be accelerated by heating a photosensitive material having been subjected to exposure. The heating temperature is preferably from 40 to 200° C. , more preferably from 70 to 180° C. , and most preferably from 80 to 160° C. Heating can be performed by means of a hot plate, a heat roller, infrared ray irradiation and a hot drum.

The heating time is preferably from 0.1 to 100 seconds, more preferably from 0.5 to 30 seconds, and most preferably from 1 to 20 seconds.

The dye precursors represented by formula (Ia) which can be used in the method for forming a color image according to the present invention will be described in detail below.

In formula (Ia), the coupler residue formed by $Q^{1a}$, $Q^{2a}$, the nitrogen atom, the carbon atom, and $Y_a$ is preferably represented by the above formula (6), (9), (10), (11) or (12), with the proviso that Y represents those defined as Ya.

$R^{a1}$, R , $R^{2a}$, $R^{3a}$, and $R^{4a}$, and $n^a$ in formula (Ia) are the same as $R^1$, $R^2$, $R^3$, $R^4$, and n in formula (I), respectively.

As the specific examples of the compounds represented by formula (Ia), the compounds represented by formulae (I-31), (I-32) and (I-33) are shown below, in addition to the specific examples of the compounds represented by formula (I), but the present invention is not limited to these compounds.

(I-31)

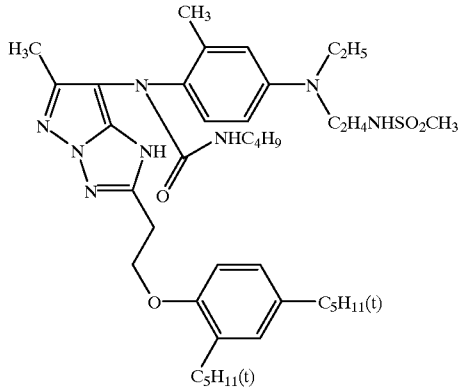

(I-32)

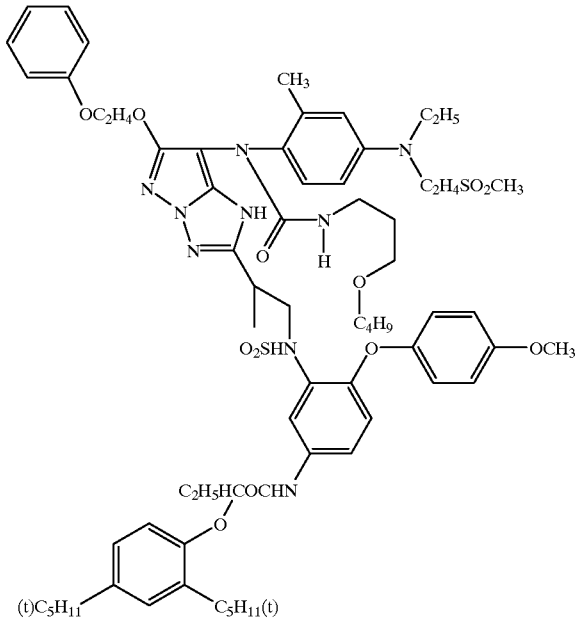

-continued (I-33)

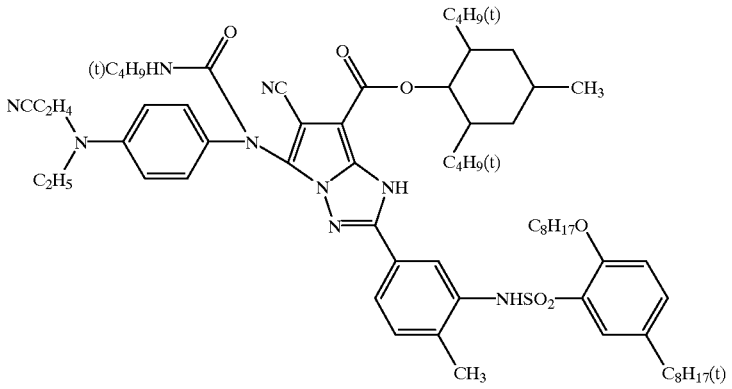

The compound represented by formula (Ia) can also be synthesized similarly to the synthesis of the compound represented by formula (I).

For color-developing the dye precursor according to the present invention, oxidation by silver salts, treatment by acid, or a combination thereof can be combined with heat treatment.

EXAMPLE 1

Compound (I-1) (10 mg) was put in a test tube and further 0.5 mg of trifluoroacetic acid was added thereto, which was designated as Sample 1-A. Samples were prepared in a similar manner using Compound (I-14), Compound (I-28), Comparative Compound (1) disclosed in WO 90/00978, and Comparative Compound (2) disclosed in WO 94/22052, which were designated as Samples 14-A, 28-A, EX1-A, and EX2-A, respectively. After each of these samples was immersed in an oil bath at 50° C. for 2 minutes, the amount of dye formed was measured by HPLC (high performance liquid chromatography), and the conversion efficiency from the dye precursor to the dye was calculated.

Comparative Compound (1)

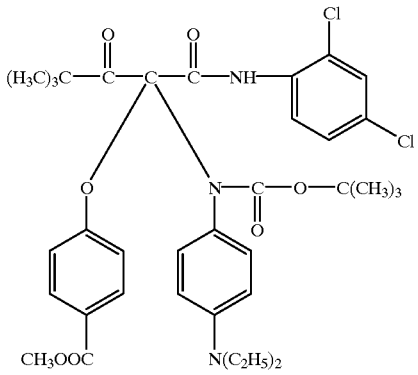

Comparative Compound (2)

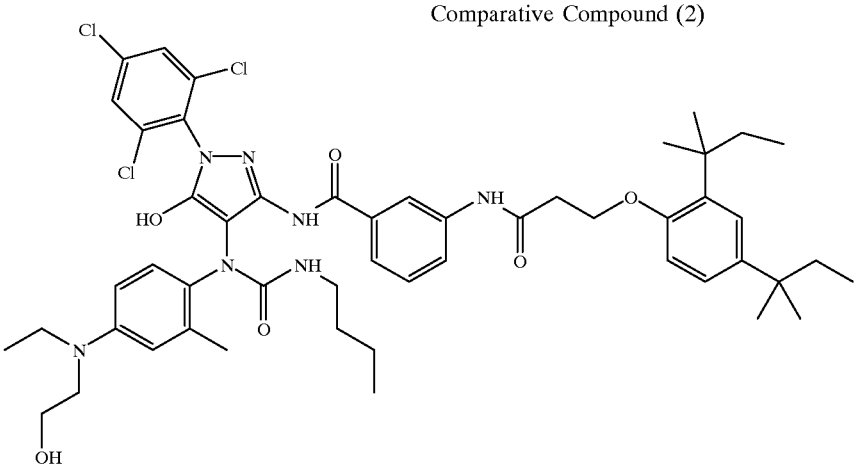

TABLE 1

| Sample No. | Dye conversion efficiency |
|---|---|
| 1-A | 72% |
| 14-A | 80% |
| 28-A | 70% |
| EX1-A | 32% |
| EX2-A | <1% |

As is apparent from the results in Table 1, the compounds according to the present invention exhibited high color-forming capability in the presence of electrophilic agents.

EXAMPLE 2

Compound (I-1) (10 mg) was put in a test tube and further 200 mg of silver acetate was added thereto, which was designated as Sample 1-B. Samples were prepared in a similar manner using Compound (I-14), Compound (I-28), Comparative Compound (1) disclosed in WO 90/00978, and Comparative Compound (2) disclosed in WO 94/22052, which were designated as Samples 14-B, 28-B, EX1-B, and EX2-B, respectively. After each of these samples was immersed in an oil bath at 70° C. for 2 minutes, the amount of dye formed was measured by HPLC, and the conversion efficiency from the dye precursor to the dye was calculated.

TABLE 2

| Sample No. | Dye conversion efficiency |
|---|---|
| 1-B | 2% |
| 14-B | 1% |
| 28-B | <1% |
| EX1-B | 2% |
| EX2-B | 37% |

EXAMPLE 3

Compound (I-1) (10 mg) alone was put in a test tube, which was designated as Sample 1-C. Samples were prepared in a similar manner using Compound (I-14), Compound (I-28), Comparative Compound (1) disclosed in WO 90/00978, and Comparative Compound (2) disclosed in WO 94/22052, which were designated as Samples 14-C, 28-C, EX1-C, and EX2-C, respectively. After each of these samples was immersed in an oil bath at 150° C. for 2 minutes, the amount of dye formed was measured by HPLC, and the conversion efficiency from the dye precursor to the dye was calculated.

TABLE 3

| Sample No. | Dye conversion efficiency |
|---|---|
| 1-C | 1% |
| 14-C | 3% |
| 28-C | 1% |
| EX1-C | 35% |
| EX2-C | 3% |

As is apparent from the results in Tables 2 and 3, the compounds according to the present invention exhibited high stability in the absence of an acid.

From the above results, the effect of the present invention is apparent.

The present invention can provide a dye precursor useful for a printing material for digital image information output which substantially does not form a dye by heating the dye precursor alone or by the action of an oxidizing agent but forms a dye by the action of an acid.

EXAMPLE 4

Compound (I-28) (0.036 g), 0.033 g of Michler's ketone, 0.053 g of diphenyliodonium trifluoromethanesulfonate as an acid generating agent, 0.15 g of tricresyl phosphate, and 2.6 g of a 10% methyl ethyl ketone solution of polystyrene were mixed and dissolved. The solution was coated on a polyethylene terephthalate film in a coating amount of 35 ml/m$^2$ and dried. Thereon was coated a coating solution for a protective layer obtained by mixing 10 g of a 16% aqueous solution of PVA 205 (manufactured by Kuraray Co., Ltd.) and 10 g of a 5% aqueous solution of the surfactant shown below in a coating amount of 21 Ml/m$^2$ and dried to thereby obtain Sample 1.

Sample 1 was subjected to exposure through a step wedge with a 500 W mercury lamp from a distance of 10 cm for 10 seconds, and then heated from the back side at 150° C. for 40 seconds, whereby a negative image in which cyan color was developed on the exposed area was obtained.

EXAMPLE 5

Compound (I-1) (0.45 g) and 1.8 g of ethyl acetate were mixed and dissolved, which was designated as Oil Phase-1. On the other hand, 1.3 g of a 16% aqueous gelatin solution, 0.034 g of a 5% aqueous sodium dodecylbenzenesulfonate solution, and 2.18 g of water were mixed, which was designated as Water Phase-1. Water Phase-1 was added to Oil Phase-1 and emulsified dispersed by means of a homogenizer. Water (2.73 g) was added to the above emulsified solution and mixed. The mixed solution was coated on a polyethylene terephthalate film having a gelatin undercoat layer in a coating amount of 17.5 Ml /m$^2$ and dried to thereby obtain a color coupler sheet.

On the other hand, 0.3 g of Compound (III-1), 0.006 g of Compound (BO-1) shown below, 0.003 g of Compound (DY-1) shown below, and 0.3 g of ethyl acetate were mixed and dissolved, which was designated as Oil Phase-2. On the other hand, 1.08 g of a 14% aqueous gelatin solution, 0.26 g of a 5% aqueous sodium dodecylbenzenesulfonate solution, and 0.57 g of water were mixed, which was designated as Water Phase-2. Water Phase-2 was added to Oil Phase-2, and emulsified and dispersed by means of a homogenizer. Water (2 g) was added to the above emulsified solution and mixed. The mixed solution was coated on a polyethylene terephthalate film having a gelatin undercoat layer in a coating amount of 21 ml/m$^2$ and dried to thereby obtain an alkylating agent sheet.

(BO-1)

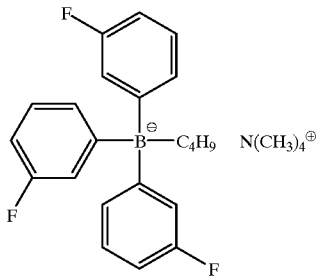

(DY-1)

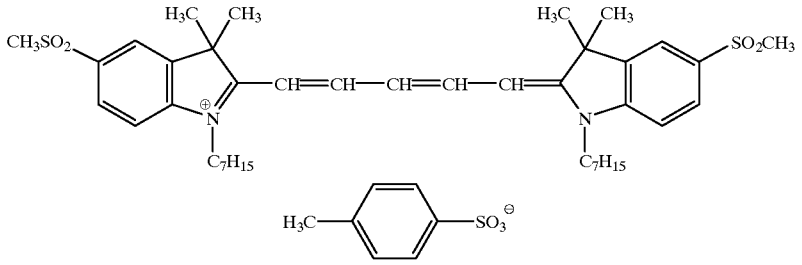

The alkylating agent sheet was subjected to exposure through a step wedge having transmission density of density 0 to 4 with a halogen lamp of 100,000 lux for 10 seconds. The alkylating agent sheet and the color coupler sheet were stuck together so that coated surfaces contacted to each other, and then heated from the back side of the alkylating agent sheet at 130° C. for 10 seconds. Two sheets were peeled off after heating, whereby a positive image of magenta color was obtained on the color coupler sheet. That is, the density of the area corresponding to the exposed part of the stuck alkylating agent sheet became Dmin and that of the area corresponding to the unexposed part became Dmax. It is considered that the image was obtained because Compound (III-1) polymerized on the exposed part of the alkylating agent sheet and the transferability of the compound was reduced.

The present invention can provide a photosensitive material containing a dye precursor useful for a printing material for digital image information output which does not necessitate an oxidizing agent such as a silver salt in color-forming.

EXAMPLE 6

Compound (I-1) (5 μmol) was put in a test tube and further 0.5 ml of trifluoroacetic acid was added thereto, which was designated as Sample 1-D. Samples were prepared in a similar manner using Compound (I-14) and Comparative Compound (2) disclosed in WO 94/22052, which were designated as Samples 14-D and EX2-D, respectively. After each of these samples was immersed in an oil bath at 70° C. for 2 minutes, 100 ml of ethyl acetate was added thereto, followed by washing with aqueous sodium bicarbonate. Ethyl acetate was added to the solution to make the volume 500 ml. The solution was put in a quartz cell of 1 cm and the absorbance of the solution at 550 nm was measured by means of a spectrophotometer (Shimadzu UV-160A).

Comparative Compound (2)

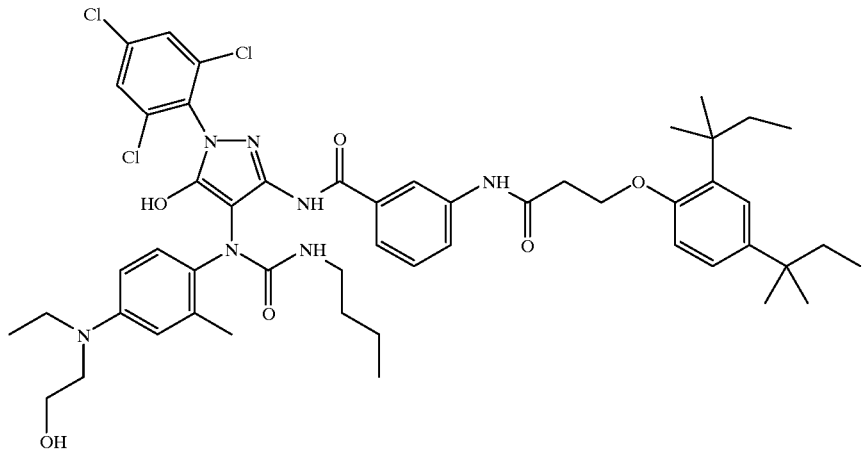

Comparative Compound (3)

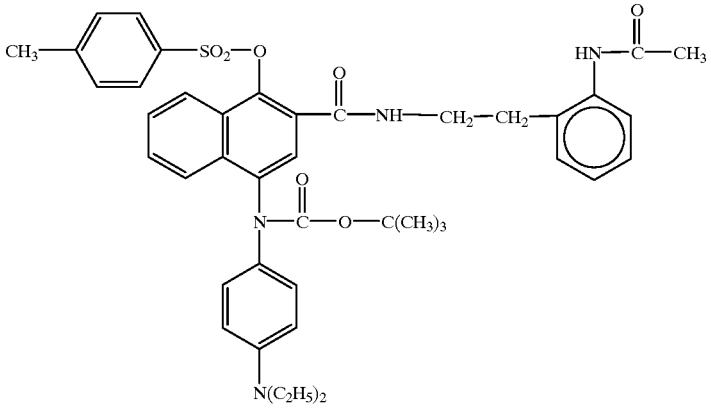

TABLE 4

| Sample No. | Absorbance |
|---|---|
| 1-D | 0.32 |
| 14-D | 0.41 |
| EX2-D | 0.08 |

As is apparent from the results in Table 4, high magenta density could be obtained by using the compounds according to the present invention.

EXAMPLE 7

Compound (I-27) (5 μmol) was put in a test tube and further 0.5 ml of silver acetate trifluoroacetic acid was added thereto, which was designated as Sample 27-E. Samples were prepared in a similar manner using Compound (I-28) and Comparative Compound (3) disclosed in WO 90/00978, which were designated as Samples 28-E and EX3-E, respectively. After each of these samples was immersed in an oil bath at 70° C. for 2 minutes, 100 ml of ethyl acetate was added thereto, followed by washing with aqueous sodium bicarbonate. Ethyl acetate was added to the solution to make the volume 500 ml. The absorbance of the solution at 650 nm was measured by means of a spectrophotometer (Shimadzu UW-160A).

TABLE 5

| Sample No. | Absorbance |
|---|---|
| 27-E | 0.44 |
| 28-E | 0.48 |
| EX3-E | 0.29 |

As is apparent from the results in Table 5, high cyan density could be obtained by using the compounds according to the present invention.

From the above results, the effect of the present invention is apparent.

An excellent image useful for a printing material for digital image information output can be obtained by the image-forming method according to the present invention using a dye precursor which shows high color density and forms a color having excellent absorption wavelength.

While the invention has been described in detail and with reference to specific examples thereof, it will be apparent to one skilled in the art that various changes and modifications can be made therein without departing from the spirit and scope thereof.

What is claimed is:

1. A dye precursor represented by the following formula (I):

(I)

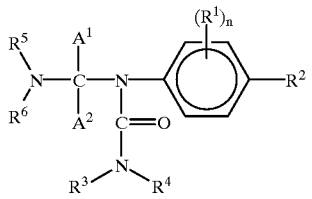

wherein $A^1$ and $A^2$ each represent an atomic group to form a coupler residue together with —N($R^5$) ($R^6$) and the carbon atom to which $A^1$ and $A^2$ are bonded; $R^1$ represents a substituent; n represents an integer of from 0 to 4; $R^2$ represents a hydroxyl group or a group represented by —N($R^7$)$R^8$; $R^7$ and $R^8$ each independently represents a hydrogen atom or a substituent; $R^3$ and $R^4$ each independently represents a hydrogen atom or a substituted or unsubstituted alkyl group; and $R^5$ and $R^6$ each independently represents a substituent.

2. The dye precursor as claimed in claim 1, which substantially does not form a dye by heating the dye precursor alone or by an oxidation reaction but forms a dye by the action of an acid.

3. A photosensitive material which comprises a dye precursor represented by formula (I):

(I)

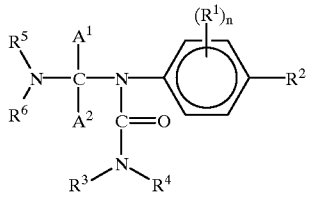

wherein $A^1$ and $A^2$ each represents an atomic group to form a coupler residue together with —N($R^5$)$R^6$ and the carbon atom to which $A^1$ and $A^2$ are bonded; $R^1$ represents a substituent; n represents an integer of from 0 to 4; $R^2$represents a hydroxyl group or a group represented by —N($R^7$)$R^8$; $R^7$ and $R^8$ each independently represents a hydrogen atom or a substituent; $R^3$ and $R^4$ each independently represents a hydrogen atom or a substituted or unsubstituted alkyl group; and $R^5$ and $R^6$ each independently represents a substituent.

4. The photosensitive material as claimed in claim 3, which further comprises a polymerizable electrophilic agent.

5. A method for forming a color image which comprises using a dye precursor represented by the following formula (Ia), along with an oxidizing agent, an acid, or a combination thereof, and effecting heat treatment:

(Ia)

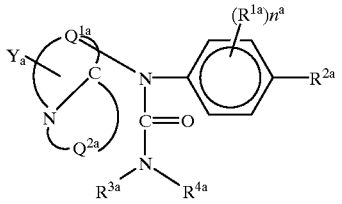

wherein $R^{1a}$ represents a substituent; $n^a$ represents an integer of from 0 to 4; $R^{2a}$ represents a hydroxyl group or a group represented by —N($R^{5a}$)$R^{6a}$; $R^{5a}$ and $R^{6a}$ each independently represents a hydrogen atom or a substituent; $Q^{1a}$ and $Q^{2a}$ each represents a nonmetallic atomic group necessary to form a nitrogen-containing heterocyclic condensed type coupler residue together with the nitrogen atom, the carbon atom, and $Y_a$; $R^{3a}$ and $R^{4a}$ each independently represents a hydrogen atom or a substituted or unsubstituted alkyl group; $Y_a$ represents a hydrogen atom or a group represented by —N($R^{7a}$)$R^{8a}$ bonded to the coupling position of the coupler mother nucleus; and $R^{7a}$ and $R^{8a}$ each independently represents a substituent.

6. The method as claimed in claim 5, wherein in formula (Ia) the coupler residue formed by $Q^{1a}$, $Q^{2a}$, the nitrogen atom, the carbon atom, and $Y_a$ is represented by the following formula (6), (9), (10), (11) or (12):

(6)

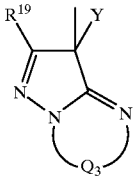

wherein $R^{19}$ represents a hydrogen atom or a substituent; $Q_3$ represents a nonmetallic atomic group necessary to form a 5-membered ring containing from 2 to 4 nitrogen atoms; and Y has the same meaning as $Y_a$ in formula (Ia);

(9)

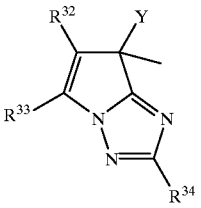

-continued
(10)
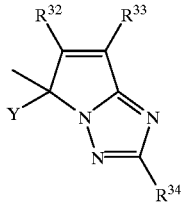
(11)
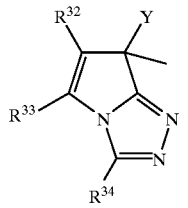
-continued
(12)
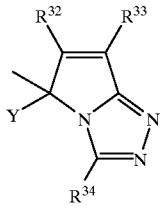
wherein $R^{32}$, $R^{33}$ and $R^{34}$ each independently represents a hydrogen atom or a substituent; and Y has the same meaning as $Y_a$ in formula (Ia).
* * * * *